US010241463B2

(12) United States Patent
Yabuki et al.

(10) Patent No.: US 10,241,463 B2
(45) Date of Patent: Mar. 26, 2019

(54) IMAGE FORMING DEVICE PREVENTING ESCAPE OF ULTRAFINE PARTICLES INTO AIR

(71) Applicant: KONICA MINOLTA, INC., Chiyoda-ku, Tokyo (JP)

(72) Inventors: Shinichi Yabuki, Toyokawa (JP); Tadayasu Sekioka, Toyohashi (JP); Shigeru Tashiro, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/899,431

(22) Filed: Feb. 20, 2018

(65) Prior Publication Data

US 2018/0239298 A1 Aug. 23, 2018

(30) Foreign Application Priority Data

Feb. 23, 2017 (JP) ..... 2017-032461

(51) Int. Cl.
*G03G 21/10* (2006.01)
*G03G 21/16* (2006.01)
(Continued)

(52) U.S. Cl.
CPC ..... *G03G 21/10* (2013.01); *G03G 15/2017* (2013.01); *G03G 15/2064* (2013.01); *G03G 15/50* (2013.01); *G03G 15/657* (2013.01); *G03G 15/6573* (2013.01); *G03G 21/1633* (2013.01); *G03G 21/206* (2013.01); *G03G 2221/0005* (2013.01); *G03G 2221/1639* (2013.01); *G03G 2221/1645* (2013.01)

(58) Field of Classification Search
CPC .. G03G 21/10; G03G 15/2017; G03G 15/657; G03G 15/6573; G03G 15/2064; G03G 21/1633; G03G 15/50; G03G 21/206; G03G 2221/1645; G03G 2221/1639; G03G 2221/0005
USPC ..... 399/44
See application file for complete search history.

(56) References Cited

U.S. PATENT DOCUMENTS

2008/0217556 A1 9/2008 Kagawa et al.
2013/0243471 A1 9/2013 Ikeda et al.
2013/0272749 A1* 10/2013 Montag ..... G03G 15/104 399/251

FOREIGN PATENT DOCUMENTS

JP 2005055515 3/2005
JP 2007-047496 2/2007
(Continued)

OTHER PUBLICATIONS

Extended European Search Report issued in corresponding European Patent Application No. 18158066.3-1022, dated Jul. 6, 2018 (9 pages).

*Primary Examiner* — Susan S Lee
(74) *Attorney, Agent, or Firm* — Buchanan Ingersoll & Rooney PC

(57) ABSTRACT

Inside the body of an image forming device, first to fifth electric charge providers are mounted in a first location out of a path of an air flow to the suction unit caused by the action of the suction unit, and a sixth electric charge provider is mounted in a second location through which external air flows in the body caused by the action of the suction unit. Each electric charge provider emits charges in ambient air to cause ultrafine particles floating in the ambient air to clump together.

16 Claims, 7 Drawing Sheets

(51) Int. Cl.

| | |
|---|---|
| ***G03G 15/00*** | (2006.01) |
| ***G03G 15/20*** | (2006.01) |
| ***G03G 21/20*** | (2006.01) |

(56) References Cited

FOREIGN PATENT DOCUMENTS

| | | | |
|---|---|---|---|
| JP | 2008-251514 | A | 10/2008 |
| JP | 2015118242 | | 6/2015 |
| JP | 2016-24428 | A | 2/2016 |

* cited by examiner

IMAGE FORMING DEVICE PREVENTING ESCAPE OF ULTRAFINE PARTICLES INTO AIR

This application claims priority to Japanese Patent Application No. 2017-032461, filed Feb. 23, 2017, the contents of which are hereby incorporated by reference in their entirety.

BACKGROUND

1. Technical Field

The invention relates to image forming devices, and in particular, a technology of preventing escape of ultrafine particles from the devices into ambient air.

2. Related Art

Electrophotographic image forming devices such as laser printers and copiers, form images on sheets by toner, and thermally fuse the toner images onto the sheets. On thermal fusing, necessity of preventing escape of ultrafine particles (UFPs) and volatile organic compounds (VOCs) has been pointed out for some time. "UFPs" are defined as fine particles whose diameters are typically 100 μm or less. It is known that electrophotographic image forming devices include, as main sources of UFPs and VOCs, silicone rubber covering outer circumferential surfaces of fusing rollers, fusing belts, etc., and external additives attached to toner particles. When substances of these sources are evaporated under a high-temperature environment caused by fusing process and diffuse around the fuser or inside sheet conveyance paths, then the substances are cooled and clump, together to form UFPs. Since there are growing concern about deleterious effects of UFPs etc., on environments and human bodies, image forming devices are required to prevent UFPs etc., from escaping into external air. For example, image forming devices disclosed in JP 2016-024428 and JP 2008-251514 are equipped with air ventilations to capture UFPs etc. These ventilations suck and filter air in fusers and sheet conveyance paths with fans, thus collecting and removing UFPs etc. from the air. Especially in ducts, the ventilations charge UFPs etc. by corona discharge, or make UFPs etc. absorb air ions generated by ion generators, thus improving rates of collection of UFPs etc. by filters.

SUMMARY

Further increase in productivity of image forming devices is desired, and in order to meet the desire, a further increase in speed is necessary throughout image forming processes such as sheet conveyance. Fusing processes are also required to reduce the time necessary for heating each sheet by raising the temperature of heating members such as fusing rollers.

However, raising fusing temperature increases the number of UFPs etc. generated in a fuser and its vicinity. 96% of the UFPs are sucked by the above-mentioned ventilation and flow into filters, whose rates of collection of UFPs reach 98% or higher, and thus, at least 96% times 98%=94% of the UFPs generated in the fuser and its vicinity are prevented from escaping into external air. On the other hand, 4% of the UFPs, which are not sucked by the above-mentioned ventilation and deviate from the flow into filters, leak from clearances or openings of the body of an image forming device into external air. These UFPs are greater than UFPs that flow into filters but slip through the filters without being trapped: 4%>96% times 2%=2%. Accordingly, in order to maintain a sufficiently small number of UFPs that can escape into external air regardless of increase in fusing temperature, a reduction in number of UFPs that deviate from the flow into filters and leak into external air is more effective than a further increase in rate of collection of UFPs by the filters.

Such reduction in number of UFPs is difficult. Indeed, most UFPs deviating from flow into filters travel downstream of a conveyance path together with sheets, then leak from sheet ejection slots to the outside of the body of an image forming device. Since the ejection slots cannot be covered, it is difficult to confine these UFPs to the body. Even if the ejection slots were covered, UFPs could leak from other clearances in the body, for example, clearances at a perimeter of a door for replacement of toner bottles, a door for maintenance, or a recess for storage of a manual feed tray since an UFP has a diameter of nanometers. Hermetically sealing all of these clearances is unrealistic in both the aspects of the effect of preventing the escape of UFPs and of the manufacturing cost of an image forming device. Furthermore, leak of UFPs from an inlets of external air to the outside of the body cannot be avoided when a ventilation stops a fan because of its waiting mode or the like; the ventilation uses external air to cool elements generating a large amount of heat such as a controller board, power supply board, and motors for conveyance rollers.

An object of the invention is to solve the above-mentioned problems, and in particular, to provide an image forming device capable of reducing UFPs that can deviate from flow into filters and leak from the body into external air.

An image forming device according to one aspect of the invention is a device of electrophotographic type. This device includes a fuser, a body, a suction unit, and an electric charge provider. The fuser thermally fuses a toner image on a sheet. The body contains the fuser. The suction unit sucks air from the inside of the body. The electric charge provider emits electric charges in ambient air to cause ultrafine particles floating in the ambient air to clump together. The electric charge provider is mounted in either or both of first and second locations inside the body; the first location is at least one region out of a path of an air flow to the suction unit caused by the action of the suction unit, and the second location is at least one region through which external air flows into the body due to the action of the suction unit.

BRIEF DESCRIPTION OF THE DRAWINGS

The advantages and features provided by one or more embodiments of the invention will become more fully understood from the following description taken in conjunction with the accompanying drawings which are given by way of illustration only, and thus are not intended as a definition of the limits of the invention. In the drawings.

DETAILED DESCRIPTION

The following is a description of embodiments of the invention with reference to the drawings.

Appearance of Image Forming Device

Figure 1A:
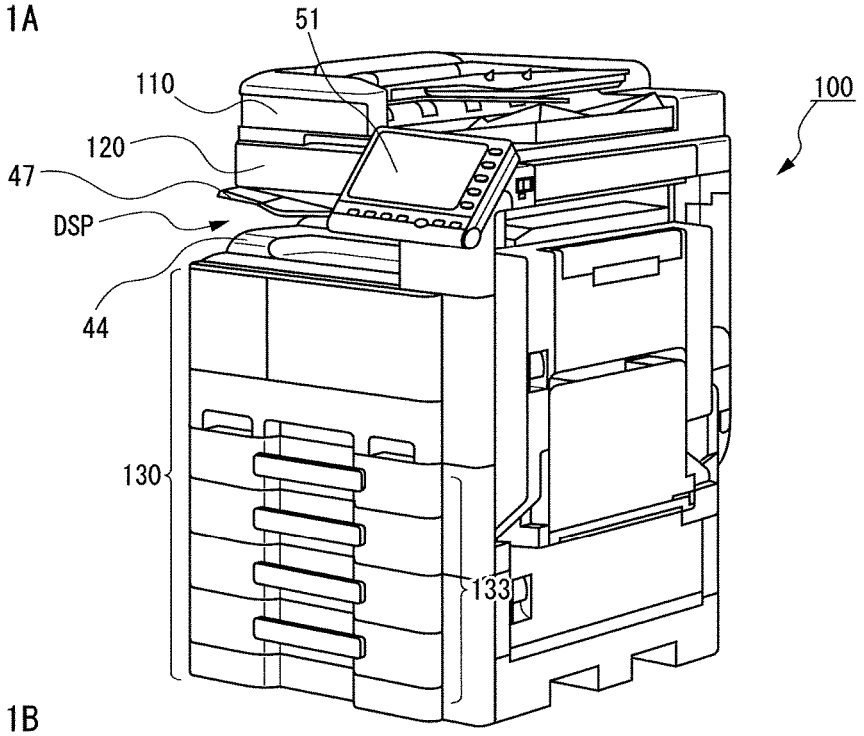
FIG. 1A is a perspective view of the appearance of a printer according to an embodiment of the invention.

FIG. 1A is a perspective view of the appearance of an image forming device according to an embodiment of the invention. The image forming device 100 is a multi-function peripheral (MFP) of the in-body paper ejection type, which combines image forming functions of a scanner, color copier, and color laser printer. The MFP 100 has, on the top surface of its body, an auto document feeder (ADF) 110. In an upper portion of the body directly below the ADF 110, the MFP 100 houses a scanner 120, and in a lower portion of the body, it includes a printer 130 with a lower portion to which paper cassettes 140 are attached to be able to slide out like drawers. There is a gap DSP between the scanner 120 and the printer 130, in which the MFP 100 has an ejection tray 44. Although not shown in FIG. 1A, next to the ejection tray 44, the MFP 100 has an ejection slot, from which the MFP 100 ejects sheets to the ejection tray 44. Above the ejection tray 44 in the gap DSP, the MFP 100 has a reverse tray 47, on which a sheet printed on its front side reverses its direction of motion during duplex printing. More specifically, the sheet is conveyed to a position where a portion of the sheet hangs out of a reverse slot (not shown in FIG. 1A) above the ejection slot on the reverse tray 47, and is then taken back into the reverse slot in the reverse direction. On a front surface of the body located next to the gap DSP, the MFP 100 has an operation panel 51. The operation panel 51 includes a touch panel embedded in its front surface and surrounded by a variety of mechanical push buttons. The touch panel displays a graphical user interface (GUI) screen such as an operation screen and input screens for various information, and accepts user operation through gadgets included in the screens, such as an icon, virtual button, menu, and tool bar.

Configuration of Printer

Figure 1B:
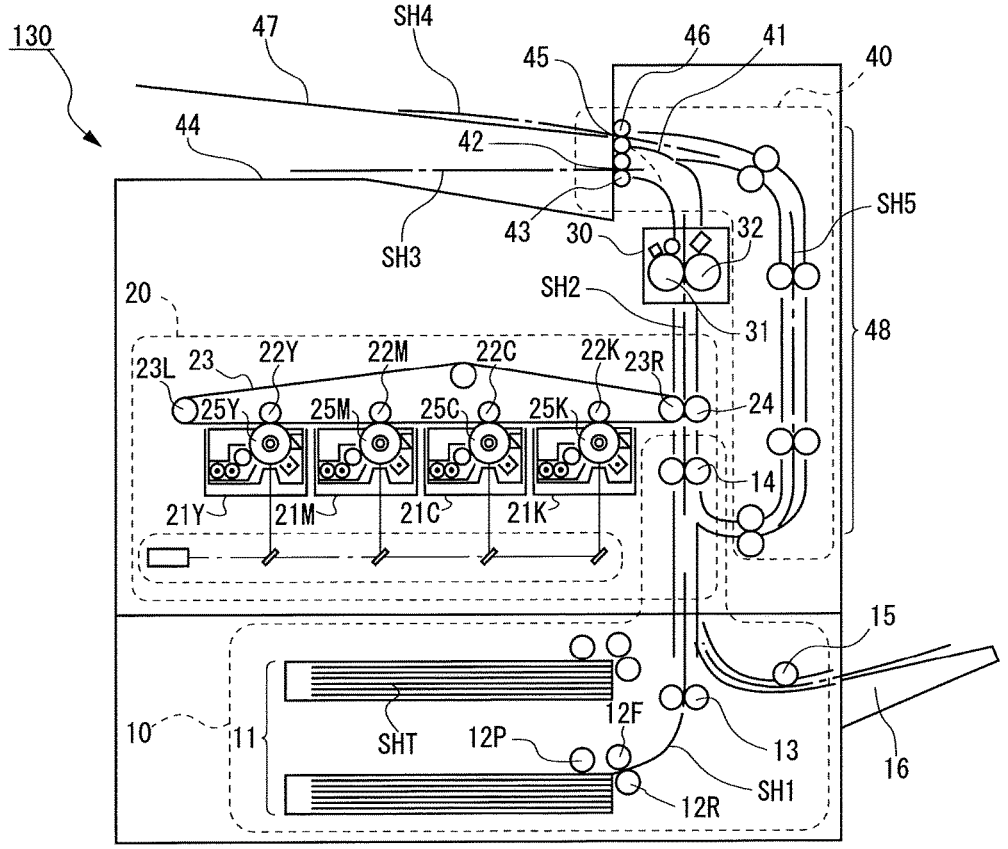
FIG. 1B is a schematic cross-sectional view of the printer along the line b-b shown in FIG. 1A.

FIG. 1B is a front view illustrating a schematic configuration of the printer 130. FIG. 1B represents elements of the printer 130 as if they can be seen through the front face of the body. The printer 130 is an electrophotographic color printer, i.e. color laser printer, which includes a feeder section 10, imaging section 20, fuser section 30, and ejector section 40.

The feeder section 10 uses feeder rollers 12P, 12F, 12R, 13, 14, 15 to feed each sheet SH1 from a stack of sheets SHT stored in a paper cassette 11 or on a manual feed tray 16 to the imaging section 20. The material of the sheets SHT is paper or resin; their paper type is plain, high-quality, coated, etc.; and their size is A3, A4, A5, B4, etc.

The imaging section 20 forms a toner image on a sheet SH2 conveyed from the feeder unit 10. More specifically, the imaging section 20 first makes four imaging units 21Y, 21M, 21C, 21K charge surfaces of their respective photoreceptor drums 25Y, 25M, 25C, 25K and expose the surfaces to laser light from an exposure unit 26 in patterns based on image data. On the surfaces, electrostatic latent images are thus formed. From the electrostatic latent images, the imaging units 21Y-21K next develop toner images of their respective colors, i.e. yellow (Y), magenta (M), cyan (C), and black (K). The imaging units 21Y-21K then transfer the resultant four one-colored toner images in order from the surfaces of the photoreceptor drums 25Y-25K onto the same position on a surface of an intermediate transfer belt 23 via electric fields between primary transfer rollers 22Y, 22M, 22C, 22K and the photoreceptor drums 25Y-25K, thus forming a single multi-colored toner image on the position. The imaging section 20 further transfers this multi-colored toner image via an electric field between the intermediate transfer belt 23 and a secondary transfer roller 24, onto a surface of the sheet SH2 passing through the nip between the intermediate transfer belt 23 and the secondary transfer roller 24. After that, the imaging section 20 separates the sheet SH2 from the secondary transfer roller 24 and sends it to the fuser section 30.

The fuser section 30 thermally fuses the multi-colored toner image to the sheet SH2 conveyed from the imaging section 20. More specifically, when the sheet SH2 passes through the nip between a fusing roller 31 and a pressure roller 32, the fusing roller 31 applies heat from its built-in heater to the sheet SH2, and the pressure roller 32 applies pressure to the heated portion of the sheet SH2, pressing the sheet SH2 against the fusing roller 31. The heat from the fusing roller 31 and the pressure from the pressure roller 32 fuse the toner image onto a surface of the sheet SH2. Then, the fusing section 30 transfers the sheet SH2 from its top portion.

The ejector section 40 ejects a sheet sent out from the fuser section 30 to the ejection tray 44 or makes the sheet reverse its direction of motion on the reverse tray 47. More concretely, when ejecting a sheet SH3 to the ejection tray 44, the ejector unit 40 makes a switching claw 41 raise its tip to open a path to the ejection slot 42. Then, the leading end of the sheet SH3 is drawn by an ejection roller 43, and thus the sheet SH3 is sent out of the ejection slot 42 to the outside of the body, and stored on the ejection tray 44. When making a sheet SH4 reverse its direction of motion at a reverse slot 45, the ejector unit 40 makes the switching claw 41 lower its tip to open a path to the reverse slot 45. Then, the leading end of the sheet SH4 is drawn by a reverse roller 46, which first rotates in the forward direction to send the sheet SH4 coming along the switching claw 41 out of the reverse slot 45 to rest on the reverse tray 47. The reverse roller 46 then reverses its rotation just prior to the rear end of the sheet SH4 passing through the reverse slot 45, thus taking back the sheet SH4 from the reverse tray 47 into the reverse slot 45, i.e. reversing the direction of motion of the sheet SH4 to convey it to a return path 48. Along the return path 48, a plurality of transport rollers return a sheet SH5 conveyed by the reverse roller 46, face down, to the conveyance path in the feeder section 10. Subsequently, the feeder section 10 again conveys the sheet SH5 to the imaging section 20, and the imaging section 20 forms a toner image on the reverse side of the sheet SH5. The fuser section 30 again thermally processes the sheet SH5, and the ejector section 40 ejects the sheet SH5 to the ejection tray 44.

Configuration of Ejection Path and its Vicinity

Figure 2A:
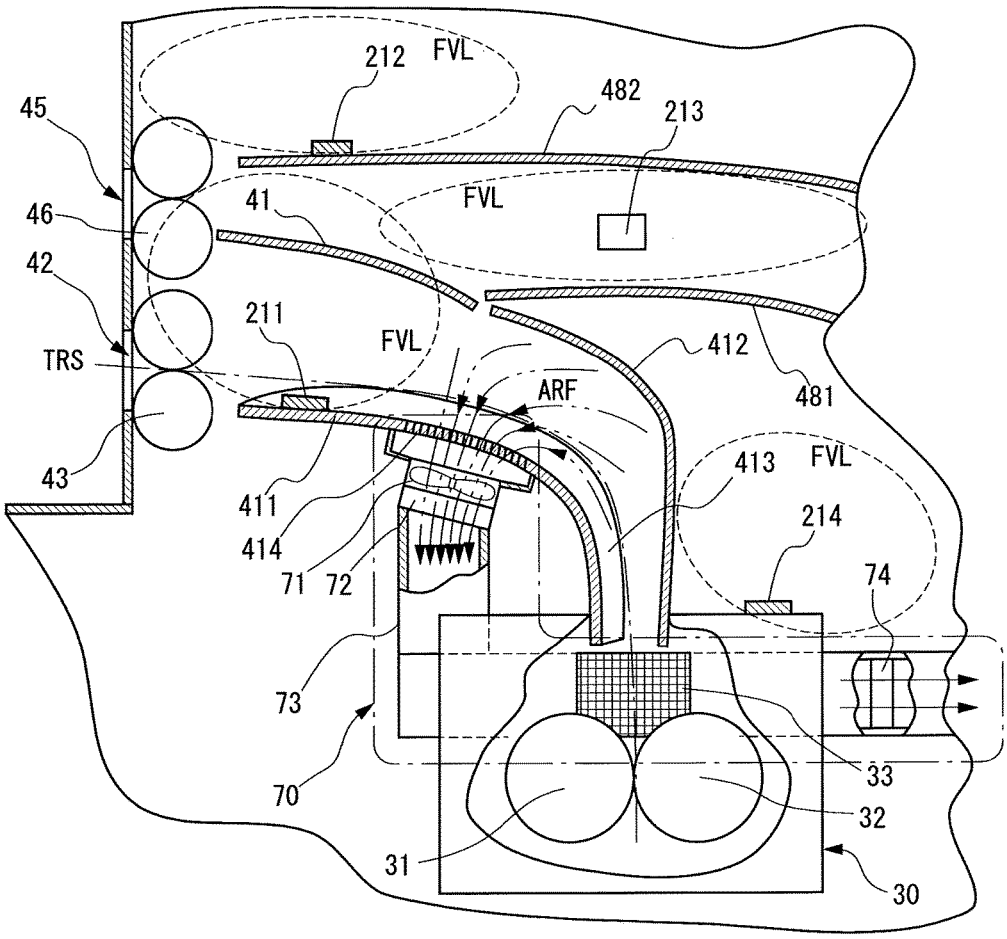
FIG. 2A is an enlarged schematic view of a sheet conveyance path from a fuser section to an ejection slot shown in FIG. 1B.

FIG. 2A is an enlarged schematic view of the sheet conveyance path from the fuser section 30 to the ejector section 42 in FIG. 1B. This path, which is hereinafter referred to as "ejection path," is a space between two guide plates 411, 412. Above the ejection path, two further guide plates 481, 482 are disposed at intervals to form the entrance of the return path 48. Near the reverse roller 46, the base end of the switching claw 41 is pivotally fixed. The switching claw 41 is a claw- or plate-shaped member of metal or hard resin, which can swing around its base end to move its tip end up and down. Each of the guide plates 411, 412, 481, 482 is a plate-shaped member of metal or hard resin, whose plate surface extends parallel to the common axial direction of the conveyance rollers 31, 32, 43, 46, the direction normal to a page of FIG. 2A. The guide plates 411, 412, which define boundaries of the ejection path, further curve from the upside of the fuser section 30 toward the ejection slot 42. Accordingly, a sheet sent out of the fuser section 30, when passing through the ejection path, bends to its front side with toner images immediately after fused, a left side of the sheet in FIG. 2A along a trajectory TRS shown by a dot-and-dash line in FIG. 2A. Hereinafter, the guide plate disposed to face the front side of the sheet, i.e. the left guide plate 411 in FIG. 2A is referred to as "inner guide," and the guide plate disposed to face the reverse side of the sheet, i.e. the right guide plate 412 in FIG. 2A is referred to as "outer guide."

Figure 2B:
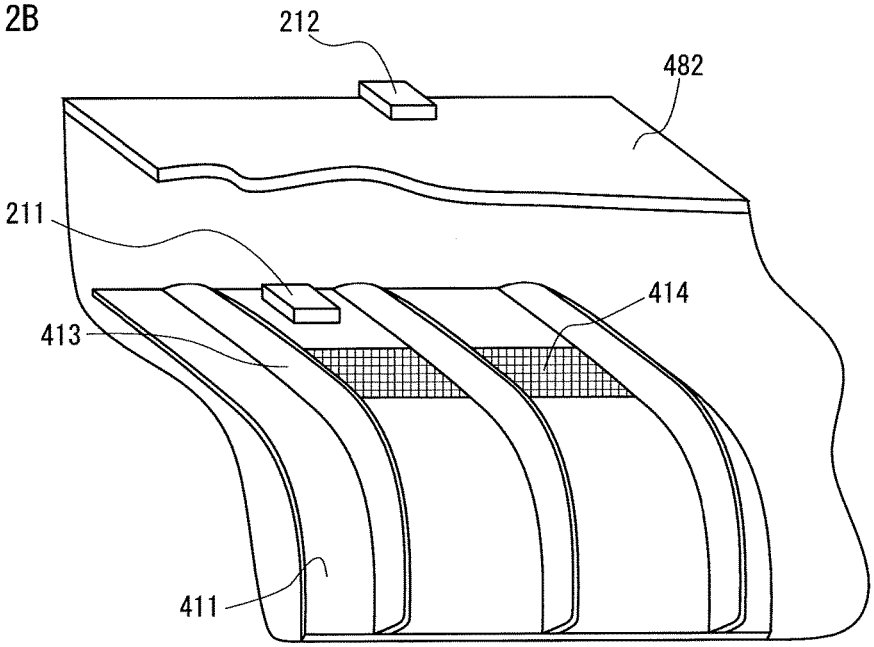
FIG. 2B is a perspective view showing an appearance of an inner guide shown in FIG. 2A.

FIG. 2B is a perspective view of the inner guide 411, which in particular shows the shape of the side of the inner guide 411 facing a sheet. This side, which is hereinafter referred to as "inner surface of the ejection path," includes ribs 413 and an air inlet 414. The ribs 413 are blade-shaped portions protruding from the inner surface to inside of the ejection path and extending in the direction of conveying sheets. The general number of the ribs 413 are two or more. The ribs 413 are arranged at intervals in the common axial direction of the conveyance rollers 31, 32, 43, 46, the horizontal direction in FIG. 2B. The air inlet 414 is a portion of the inner guide 411 that is placed between two of the ribs 413 and has many through holes, which allows the inside of the ejection path to communicate with the outside.

As shown by the trajectory TRS in FIG. 2A, a sheet travels in the ejection path along the tip ends of the ribs 413. While the sheet travels, its front side with toner images immediately after fused faces the air inlet 414. Outside the inlet 414, a suction unit 70 is disposed and includes a fan 71, first filter 72 and duct 73, which are hermetically connected with each other. The fan 71 is located directly outside the inlet 414, and the first filter 72 is directly outside the fan. The fan 71 rotates to suck air from the ejection path into the inlet 414. When the fan 71 rotates, air flows ARF occur inside the ejection path, in particular, in the space upstream of the inlet 414. These air flows AFR pass through the inlet 414 and the fan 71, and then enter the first filter 72. The first filter 72 is, for example, an electrifiable non-woven filter, which captures UFPs with electrostatic forces of the fabric as well as the fine mesh of the fabric. By this function, the first filter 72 collects and removes UFPs from the air flows ARF. These UFPs originate mainly from the fusing roller 31, the pressure roller 32, and toner attached to sheets. The duct 73 extends from the first filter 72 through a vicinity of the fuser section 30 to an air outlet in the body of the MFP 100 (not shown in figures). The duct 73 allows the air flows ARF after passage through the first filter 72 to pass out of the body. The duct 73 includes a vent 33 and second filter 74 on its way to the air outlet. The vent 33 communicates with the inside of the fuser section 30, and thus sucks air from the fuser section 30 into the duct 73 due to the air flows ARF sent by the fan 71 to the duct 73. The second filter 74 is, for example, an electrifiable non-woven filter similar to the first filter 72. The second filter 74 captures UFPs flowing out of the fuser section 30 through the vent 33.

Source of UFPs Diffusing in Ejection Path

The fusing roller 31 is a soft roller, which has an elastic layer enclosing a core; the elastic layer is made of highly elastic, heat-resistant resin such as silicone rubber. The fusing roller 31 is heated, for example, from its inside by a halogen heater disposed in a hollow of the core, or alternatively, from its outside by a high-temperature belt contact with the outer circumferential surface of the fusing roller. Thus, the temperature of the outer circumferential surface, or fusing temperature is maintained at, e.g., a hundred and tens to hundreds of degrees Celsius. The pressure roller 32 is a soft roller similar to the fusing roller 31. The pressure roller 32 is pressed against the fuser roller 31 by pressure in the order of 106 Pa from a biasing member such as a spring or electromagnet. High heat from the fusing roller 31 and high pressure from the pressure roller 32 evenly fuse the entirety of toner on the surface of a sheet in the nip between both the rollers 31, 32. High heat from the fusing roller 31 further evaporates silicone from elastic layers of both the rollers 31, 32, and external additives from toner. Vapor of silicone is cooled by ambient air and condensed into low-molecular siloxanes, which clump together to form UFPs. The external additives are, in general, fine particles attached to the surface of each toner particle, and fly apart from the toner particle into ambient air as UFPs. Because of a dielectric body, any UFP is subject to polarization when it approaches a charged object, and by the resultant electrostatic force, easily trapped around the object. The filters 72, 74, when being electrifiable non-woven fabrics, use the dielectric characteristic of UFP to realize a 98% or higher rate of collection of UFPs.

Electric Charge Provider

FIGS. 2A, 2B show the electric charge providers 211, 212, 213, 214, which are, for example, ion generators of a corona discharge or electron emission type, and each contained in a cuboidal box with edges of length some centimeters. The electric charge providers 211-214 are each connected to the power supply board of the MFP 100, although not shown in figures. By electric power received from the power supply board, the electric charge providers 211-214 emit at least either positive charges or negative ones in ambient air, thus causing UFPs floating in the air to clump together.

Configuration of Ion Generator

Figure 3A:
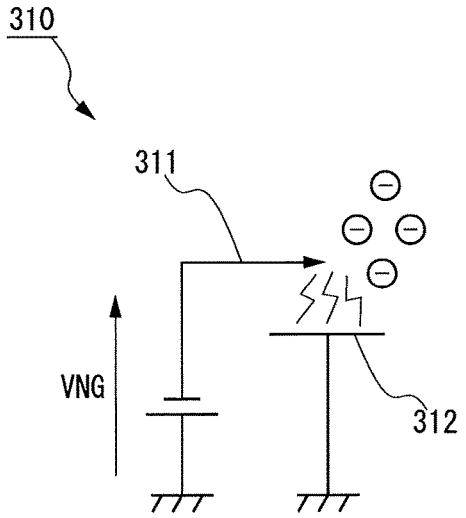
FIG. 3A is a circuit diagram of a corona discharge ion generator.
Figure 3B:
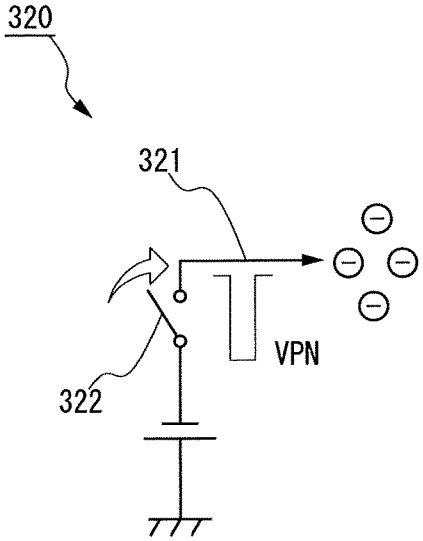
FIG. 3B is a circuit diagram of an electron emission ion generator.

FIG. 3A is a circuit diagram of an ion generator 310 of a corona-discharge type, and FIG. 3B is a circuit diagram of an ion generator 320 of an electron-emission type. The corona-discharge ion generator 310 includes a needle-shaped discharge electrode 311 and ground electrode 312 that are placed with a space in between. The discharge electrode 311 receives, for example, a negative high voltage VNG from the power supply of the MFP 100. The ground electrode 312 is connected to a grounded conductor such as a chassis of the MFP 100, not shown in figures, to be maintained at the ground potential. When the voltage between the electrodes 311, 312 exceeds an isolation limit of ambient air, a corona discharge occurs between the electrodes 311, 312, and in particular, the discharge electrode 311 emits electrons into the air. The electron-emission ion generator 320 includes a needle-shaped discharge electrode 321 and switch 322. The switch 322 controls connection between the discharge electrode 321 and the power supply of the MFP 100, thereby applying, for example, a negative pulse voltage VPN to the discharge electrode 321. Then, the discharge electrode 321 emits electrons into ambient air.

Electrostatic Cohesion of UFPs

Figure 3C:
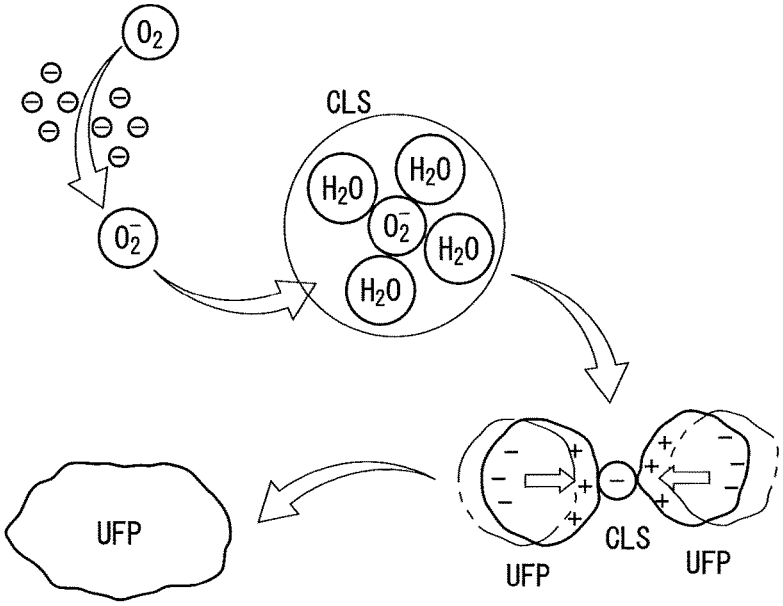
FIG. 3C is a schematic diagram of a process of UFP electrostatic cohesion.

FIG. 3C is a schematic diagram of a process of electrostatic cohesion of UFPs. Electrons emitted from the ion generator 310 or 320 are captured by molecules in air, esp. by oxygen molecules, $O_2$, which has a high electron affinity. In general, negatively ionized oxygen molecules, $O_2^-$, and the like each absorb a plurality of water molecules $H_2O$ to form clusters of so-called minus air ions, $O_2^-(H_2O)_n$, and the like. Electric fields generated by the negative charge of each minus air ion polarize UFPs floating around, and resultant electrostatic forces make the UFPs clump around the minus air ion. Thus, two or more UFPs grow a larger single UFP. In this case, the UFPs have an unchanged total weight, but their number decreases from "two or more" to one.

Variety of Locations of Electric Charge Providers

Since typical UFPs can diffuse in any inner space of the body of the MFP 100, the electric charge providers promise a certain level of effect on reduction of UFPs, wherever they are mounted within the body of the MPF 100. In order to more definitely enhance the effect on reduction of UFPs, the electric charge providers only have to be mounted in, at least, either of the following two locations: a first location is a region out of the path of the air flows ARF to the suction unit 70 caused by the action of the fan 71; a second location is a region through which external air flows into the body of the MFP 100 caused by the action of the fan 71.

First Location

The regions at which the electric charge providers 211-214 are located in FIGS. 2A, 2B are all classified as the first locations. More specifically, the first electric charge provider 211 is mounted in an area on the inner surface of the ejection path nearer to the ejection slot 42 than to the air inlet 414; the second electric charge provider 212 is mounted on the outer surface of the upper guide plate 482 that defines a boundary of the return path 48; the third electric charge provider 213 is mounted in a region on the inner surface of the return path 48 that does not touch sheets traveling the return path; and the fourth electric charge provider 214 is mounted on the outer surface of the housing of the fuser section 30. Space that surrounds any of the electric charge providers 211-214 is, as shown by broken curves FVL in FIG. 2A, out of the paths of the air flows ARF to the suction unit 70 caused by the action of the fan 71. Accordingly, there is a high risk that UFPs diffusing in the spaces FVL can escape from the flows into the first filter 72, regardless of the action of the fan 71. In these spaces FVL, however, there are a large number of minus air ions generated by the electric charge providers 211-214. These minus air ions make ambient UFPs clump together, thus reducing the number of UFPs floating in the spaces FVL.

Figure 4:
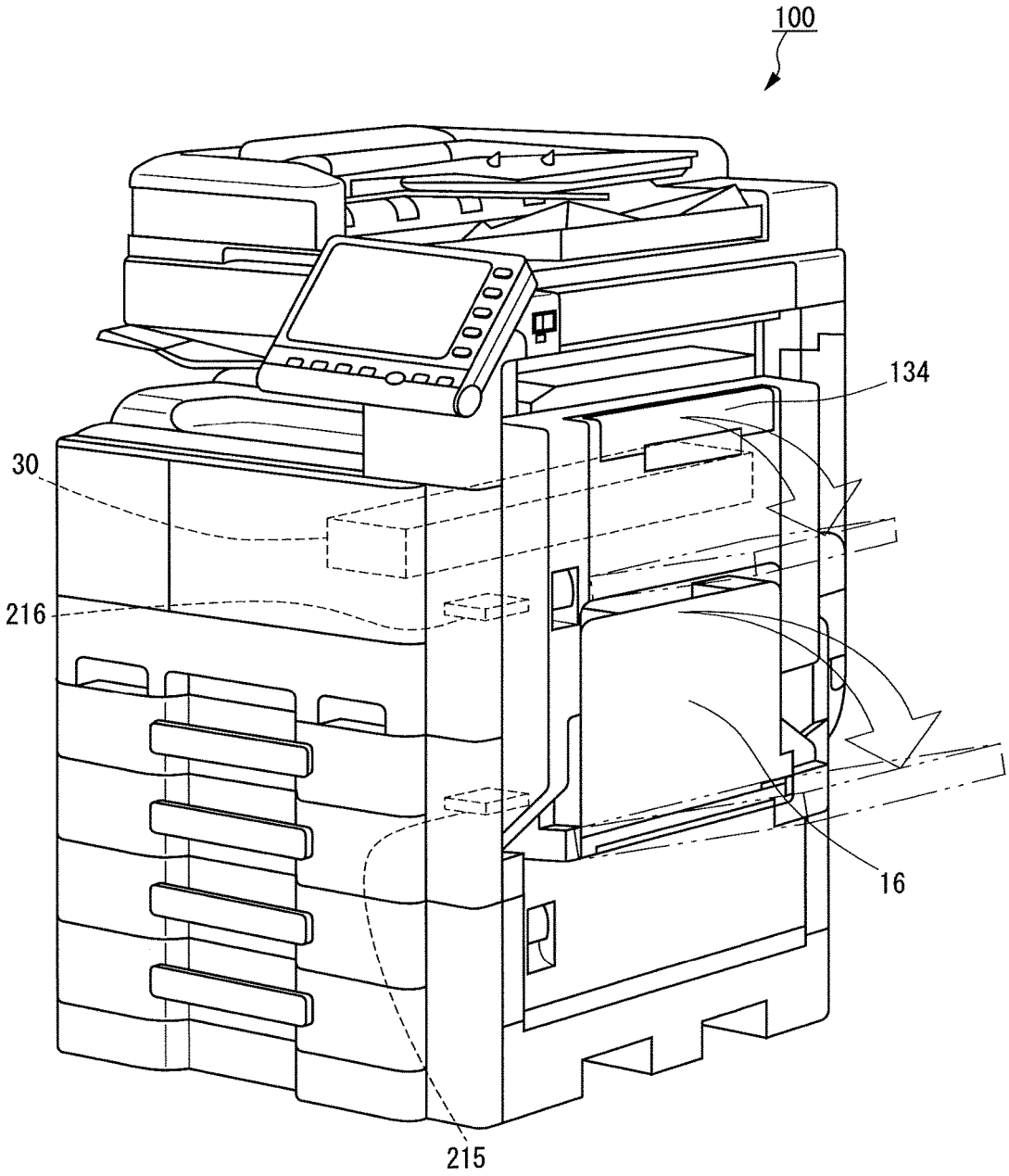
FIG. 4 is a perspective view of an appearance of a side of the printer shown in FIG. 1A.

FIG. 4 is a perspective view of the appearance of a side surface of the MFP 100. In the lower portion of the side surface, a manual feed tray 16 is mounted in an openable and closable manner. Inside a portion of the body where the manual feed tray 16 is placed, an entrance of the sheet conveyance path, or a feed slot is open, which communicates, through the conveyance path, with space around the fuser section 30. Accordingly, UFPs generated in a vicinity of the fuser section 30 can diffuse in clearances around the manual feed tray 16, from which the fan 71 cannot suck air. Hence, there is a high risk that UFPs reaching the clearances can escape from the flows into the first filter 72, regardless of the action of the fan 71. In other words, the clearances around the manual feed tray 16 and their vicinities are classified as the first location. In this space, a fifth electric charge provider 215 is mounted, and minus air ions generated by the fifth electric charge provider 215 make ambient UFPs clump together, thus reducing the number of UFPs floating in air in the clearances.

Second Location

In the upper portion of the side surface of the MFP 100 in FIG. 4, a door for maintenance 134 is mounted in an openable and closable manner. An opening covered with the door 134 communicates directly with space around the fuser section 30. As shown in FIG. 2A, air flows from the space through the air inlet 414 and vent 33 into the duct 73 caused by the action of the fan 71 of the suction unit 70. While the fan 71 operates, air pressure in the space is maintained lower than external air pressure, and in particular, external air flows in the clearances at the perimeter of the door 134 and the inside of the body. Accordingly, UFPs generated in a vicinity of the fuser section 30 hardly leak from the clearances at the perimeter of the door 134 into external air. However, once the fan 71 stops, air pressure in the space raises to external air pressure, and then the external air flow into the clearances stops. As a result, there is a rapidly increased risk that UFPs, together with internal air, leak from the clearances into external air. Like the clearances, regions that allow external air to flow therein have the risk of leaking internal air out of the body when the fan 71 stops, and are classified as the second location. In the clearances, a sixth electric charge provider 216 is mounted as shown in FIG. 4, and generates minus air ions when the fan 71 stops. The minus air ions make ambient UFPs clump together, thus reducing the number of UFPs floating in air in the clearances.

Electronic Control System of Image Forming Device

Figure 5:
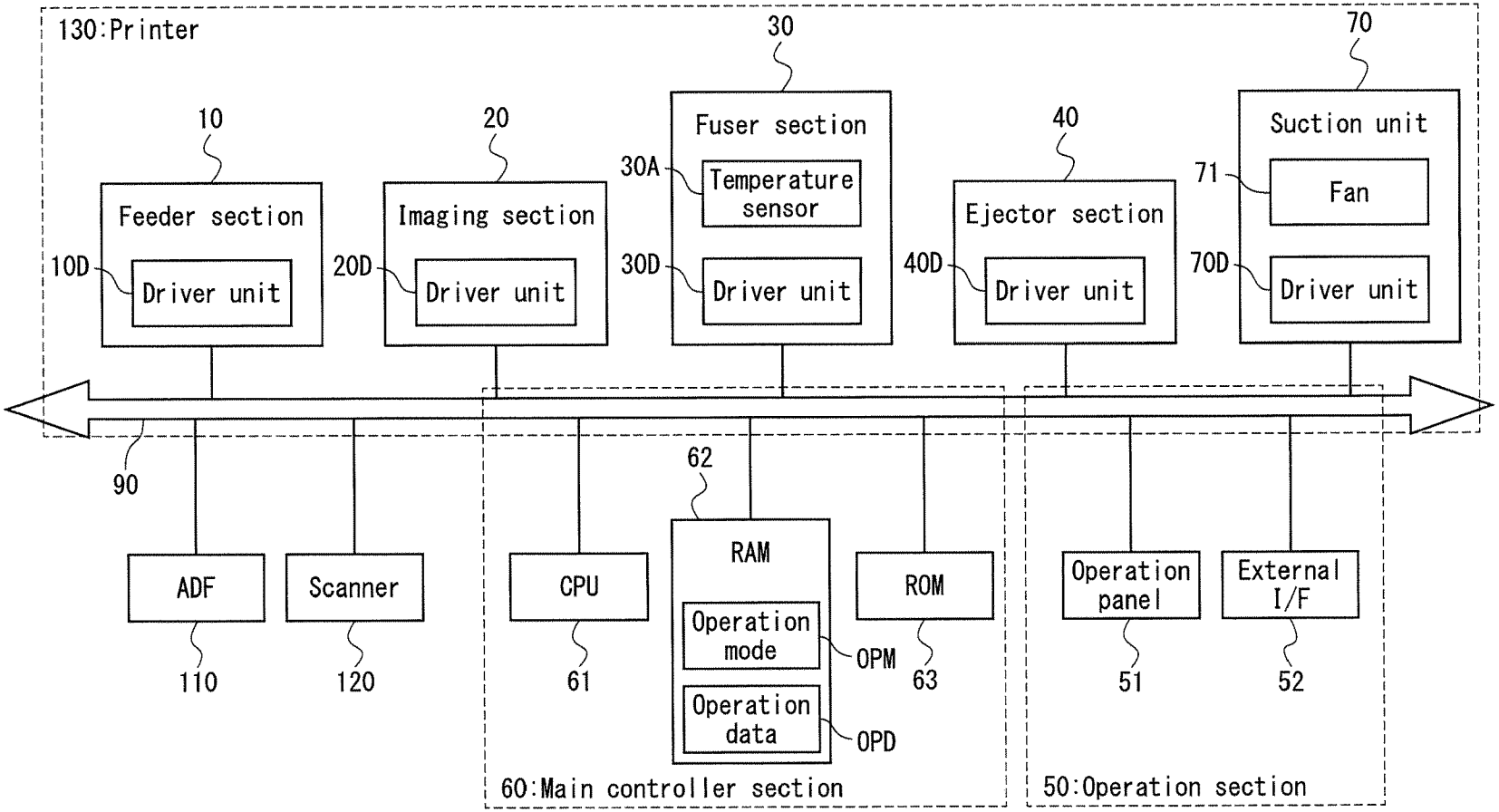
FIG. 5 is a block diagram of an electronic control system of the printer shown in FIG. 1A.

FIG. 5 is a block diagram illustrating a configuration of the electronic control system of the MFP 100. In the electronic control system, in addition to the ADF 110, the scanner 120, and the printer 130, an operation section 50 and a main controller section 60 are connected to a bus 90 to be able to communicate with each other.

Driver Unit of Printer

The components 10, 20, 30, 40, 70 of the printer 130 include their respective driver units 10D, 20D, 30D, 40D, 70D, which control movable members belonging to their own elements 10-70. The movable members include the conveyance rollers 12P, 12F, 12R, 13, 14, 15, 23R, 24, 31, 32, 43, 46 in FIG. 1B, the photoreceptor drums 25Y-25K, the primary transfer rollers 22Y-22K, the switching claw 41, and the fan 71. Each of the driver units 10D-70D has a control circuit and a driving circuit for actuators, such as motors or solenoids, driving the above-listed movable members. The control circuit, which is configured with an integrated circuit such as a microprocessor (MPU/CPU), an application specific integrated circuit (ASIC), or a field programmable gate array (FPGA), instructs the driving circuit about a target value of output of the actuator. The driving circuit is a switching converter, which uses power transistors such as field-effect transistors (FETs) or insulated gate bipolar transistors (IGBTs) as switching elements to feed electric power to actuators. According to instructions from the control circuit, the driving circuit controls power of motors to make each conveyance roller 12P, 12F, 12R, 13, 14, 15, 23R, 24, 31, 32, 43, or 46 maintain a conveyance speed of sheets at a target level, and the fan 71 maintain an intake flow amount at a target value. According to instructions from the control circuit, the driving circuit also turns on and off a solenoid to make the switching claw 41 move its tip to an appropriate position.

The driver unit 30D of the fuser section 30 further performs a feedback control for fusing temperature. Concretely, the fuser section 30 first monitors actual temperature of the outer circumferential surface of the fusing roller 31 with a temperature sensor 30A, which is of a non-contact type with a thermopile, for example. The temperature sensor 30A faces the outer circumferential surface of the fusing roller 31 at a distance, and according to output from the thermopile caused by heat radiated from the outer circumferential surface, measures the temperature of the outer circumferential surface, i.e. the fusing temperature. Based on the difference in temperature between the measured and target values, the driver unit 30D controls power supply to the heating member such as the halogen heater. Since an amount of heat from the heating member to the fusing roller 31 is adjusted, the fusing temperature is maintained at the target value.

Operation Section

The operation section 50 is the entirety of interfaces to users and external electronic devices that are implemented in the MFP 100. The operation section 50 accepts job requests and image data to be printed via user operations and/or communication with an external electronic device, and communicates received job requests and image data to the main controller section 60. As shown in FIG. 5, the operation section 50 includes an operation panel 51 and external interfaces (I/F) 52. The operation panel 51, as shown in FIG. 1, includes push buttons, a touch panel, and a display. The operation panel 51 displays graphical user interface (GUI) screens. The operation panel 51 also identifies a push button or a location on the touch panel operated by a user, and communicates information related to the identification to the main controller section 60 as operation data. Especially while displaying an input screen for print jobs, the operation panel 51 accepts printing conditions such as a size, paper type, orientation (portrait or landscape), number, image quality of sheets to be printed, and incorporates items indicating the conditions into operation data. The external I/F 52 includes a universal serial bus (USB) port or memory card slot, and through it, accepts image data to be printed from an external memory device such as a USB memory or a hard disk drive (HDD). The external I/F 52 further includes ports for communication with external networks by wired or wireless connections, and accepts image data to be printed from other electronic devices on connection to the external network.

Main Controller Section

The main controller section 60 is an integrated circuit implemented on a single printed circuit board mounted inside the MFP 100. As shown in FIG. 5, the main controller section 60 includes a CPU 61, a RAM 62, and a ROM 63. The CPU 61 is realized by an MPU, and executes various types of firmware. The RAM 62 is a volatile semiconductor memory device such as a DRAM or SRAM, and provides the CPU 61 with a workspace to execute firmware and stores image data to be printed that is received by the operation section 50. The workspace particularly stores data OPM on a current operation mode and operation data OPD received from the operation section 50. The ROM 63 is a combination of non-writable and writable non-volatile memory devices. The former stores firmware and the latter includes semiconductor memory devices such as an EEPROM, flash memory, solid-state drive (SSD), or a HDD, and provides the CPU 61 with storage for data such as environmental variables.

According to various types of firmware that the CPU 61 executes, the main controller section 60 realizes a variety of functions as the controller of other components 10-70 of the MFP 100. More specifically, the main controller section 60 makes the operation section 50 display a GUI screen and accept operations from a user. In response to operation data OPD from the operation section 50, the main controller section 60 determines an operation mode OPM of the MFP 100. Operation modes include, for example, running, waiting, and sleep modes. In the running mode, the MFP 100 processes print jobs. For example, the feeder section 10 continuously feeds the number of sheets indicated by the operation data OPD; the imaging section 20 repeats forming toner images and transferring them to sheets; the fuser section 30 continues to apply heat and pressure to sheets; the suction unit 70 makes the fan 71 continue to rotate. In the waiting mode, the MPF 100 stands ready to process a job. Concretely, the feeder section 10, the imaging section 20, and the suction unit 70 stop, and the fuser section 30 preheats the fusing roller 31 to maintain the fusing temperature at a proper value. In the sleep mode, the MFP 100 minimizes its power consumption. For example, in addition to the feeder section 10, the imaging section 20, and the suction unit 70, the fuser section 30 also stops and cuts electricity to the heating member such as the halogen heater. The main controller section 60 switches between the operation modes of the MFP 100 in response to various events occurring on the MFP 100, such as completion of processing a job, change of a stop or power button into a down state, detection of a gesture by the touch panel, or reception of a job request or stop instruction. The main controller section 60 further provides other components 10-70 of the MFP 100 with information necessary to switch between operation modes. For example, when instructing the running mode, the main controller section 60 informs the feeder section 10 of a paper type and number of sheets to be conveyed, a time when each conveyance roller 12P, 12F, 12R, 13, 14, 15, 23R, 24, 31, 32, 43, or 46 should rotate, and a target value of sheet conveyance speed; the main controller section 60 also informs the imaging section 20 of image data and a time of image processing, and the fuser section 30 of a target value of the fusing temperature, and the suction unit 70 of a target amount of intake flow of the fan 71. The main controller section 60, in addition, determines the number of minus air ions to be generated per unit time in a unit volume by each of the electric charge providers 211-216, i.e. their ion generation rates, and controls the power supply of the MFP 100 to provide the electric charge providers 211-216 with electric power corresponding to their respective ion generation rates.

Control of Suction Unit and Electric Charge Provider

In general, an optimum value of the fusing temperature depends on operation modes of the MFP 100, conveyance speeds and paper types of sheets, and coverages of images to be printed. Coverages, which also referred to as toner coverage rates, are defined as consumption amounts of toner necessary per unit area. Based on these conditions for operation of the MFP 100, the main controller section 60 determines a target value of the fusing temperature. The higher the fusing temperature, the larger the amount of silicone generated from the fusing roller 31 and the likes, and thus, the larger the number of UFPs appearing per unit time in a unit volume, i.e. the higher a UFP generation rate at the fuser section 30 and its vicinity. The higher the UFP generation rate, the higher the risk of increase in number of leaking UFPs from the MFP 100 into the external air. In order to maintain the risk at a sufficiently low level, the main controller section 60 determines a target amount of intake flow of the fan 71 and an ion generation rate of each of the electric charge providers 211-216 according to the operation conditions of the MFP 100. More concretely, the main controller section 60 monitors the operation conditions of the MFP 100; when predicting a rise of the UFP generation rate from the operation conditions, the main controller section 60 increases a target amount of intake flow of the fan 71 and an ion generation rate of each of the electric charge providers 211-216, and in particular, adjusts increments of the target amount and rates to be appropriate for the amount of the predicted rise of the UFP generation rate.

Figure 6A:
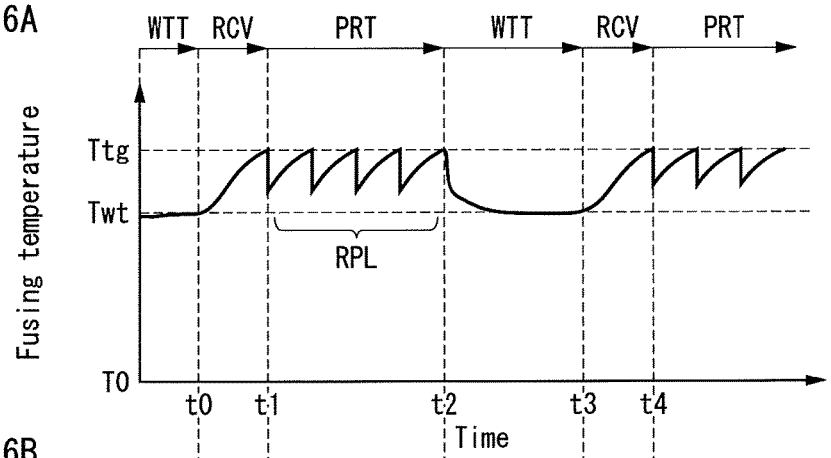
FIG. 6A is a graph showing an example of temporal change in fusing temperature.

FIG. 6A is a graph showing an example of temporal change in fusing temperature. In a waiting period WTT of the MFP 100, the operation section 50 receives a request of processing a print job at a certain time t0. In response to the request, the main controller section 60 changes the operation mode of the MFP 100 from the waiting mode to the running mode, and sets a target level of the fusing temperature to a level Ttg for the running mode, e.g. 180 degrees Celsius. According to the set level, the fuser section 30 increases a heat amount to be provided from the heating member such as the halogen heater to the fusing roller 31. Thus, the fusing temperature rapidly rises and reaches the target level Ttg by the end time t1 of a recovery period RCV. At the end time t1, the main controller section 60 also makes the printer 130 start processing the print job. In a printing period PRT following the end time t1, the fuser section 30 continues to heat the fusing roller 31 to maintain the fusing temperature at the target level Ttg, while the fusing temperature severely fluctuates due to loss of a large amount of heat from the fusing roller 31 to a sheet each time the sheet passes through the nip between the fusing roller 31 and pressure roller 32. Since sheets of heavier paper types or with toner images of higher coverages formed thereon remove larger amounts of heat from the fusing roller 31, the fluctuations in fusing temperature caused by passing sheets, i.e. thermal ripples RPL are larger. At the end time t2 of the printing period PRT, the main controller section 60 changes the running mode to the waiting mode to reduce a target level of the fusing temperature to a level Twt of the waiting mode, e.g. 150 degrees Celsius. In response to the reduction in target level, the fuser section 30 decreases a heat amount provided from the heating member to the fusing roller 31, and accordingly, the fusing temperature rapidly falls and is maintained at the target level Twt during the waiting period WTT of the MFP 100. At a time t3 after the waiting period WTT, the operation section 50 receives a request of processing a new print job, and in response to operation data indicating the request, the main controller section 60 changes the waiting mode to the running mode to raise a target level of the fusing temperature to the level Ttg of the running mode. In response to this change, the fuser section 30 increases a heat amount provided from the heating member to the fusing roller 31 during the recovery period RCV of the MFP 100, and accordingly, the fusing temperature rapidly rises and reaches the target level Ttg by the end time t4 of the recovery period RCV. At the end time t4, the main controller section 60 also makes the printer 130 start processing a new print job, and thus, ripples RPL appear in the fusing temperature during a printing period PRT following the end time t4.

Figure 6B:
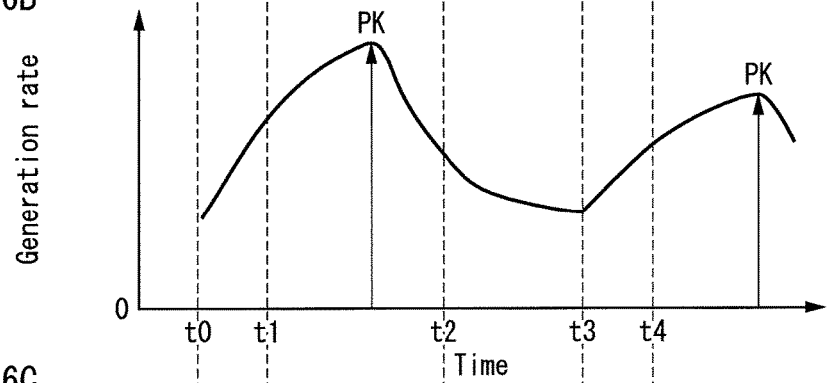
FIG. 6B is a graph showing a typical temporal change in UFP generation rate caused by the temporal change in fusing temperature in FIG. 6A.

FIG. 6B is a graph showing a typical temporal change in UFP generation rate caused by the temporal change in fusing temperature in FIG. 6A. During each recovery periods RCV of the MFP 100, the UFP generation rate rises, caused by the rise in fusing temperature. During the following printing period PRT, the ripples RPL appear in fusing temperature, but the fusing temperature is maintained at a higher value than the target level Twt in the waiting mode, and therefore UFP generation rate continues to rise as a whole, and then reaches a peak PK. Since sheets of heavier paper types or with toner images of higher coverages formed thereon remove larger amounts of heat from the fusing roller 31, amounts of heat provided from the heating member to the fusing roller 31 are also larger. The larger the amounts of heat, the higher the peak PK appearing in UFP generation rate.

Figure 6C:
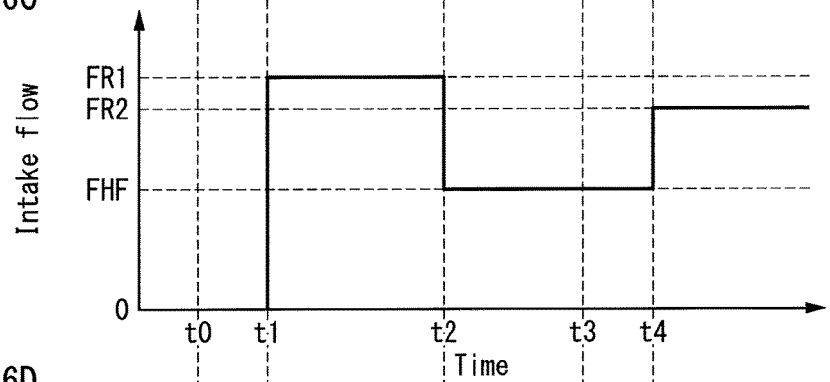
FIG. 6C is a graph showing a temporal change in target amount of intake flow of a fan determined according to the temporal change of the UFP generation rate in FIG. 6B.

FIG. 6C is a graph showing a temporal change in target amount of intake flow of the fan 71 determined according to the temporal change of the UFP generation rate in FIG. 6B. During the printing periods PRT of the MFP 100, it is expected that the UFP generation rate changes within a higher range, and thus, there is a higher risk of increase in number of UFPs leaking from the MFP 100 into external air. In order to sufficiently reduce the risk, the main controller section 60 determines a target amount of intake flow of the fan 71 according to the operation conditions of the MFP 100. Concretely, the main controller section 60 first measures the fusing temperature with the thermal sensor 30A of the fuser section 30, or predicts it from the operation mode of the MFP 100 which level the fusing temperature has: the level of the running, waiting, or sleep mode. When the measured or predicted level of the fusing temperature indicates a high level of the running mode, there is a high possibility of a rise in UFP generation rate, and thus, the main controller section 60 estimates an amount of the rise in UFP generation rate or a height of the peak PK from a paper type specified by the operation data OPD or a coverage indicated by the image data. The relationship between amounts of the rise in UFP generation rate or heights of the peak PK and paper types or coverages are represented, for example, in a form of table based on results of an experiment or a simulation. The higher the estimated value, the larger the main controller section 60 determines the target amount of intake flow of the fan 71 to be. For example, the target amount is maintained at a value FR1 when the fan 71 operates at a half speed during the waiting period WTT of the MFP 100, and at a larger value FR1 or FR2 when a higher peak PK is predicted to appear in UFP generation rate during the printing period PRT.

Figure 6D:
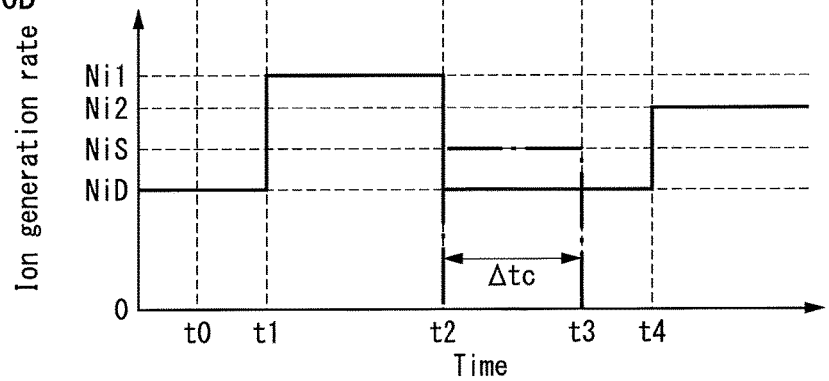
FIG. 6D is a graph showing a temporal change in ion generation rate assigned to each of the electric charge providers based on the temporal change of the UFP generation rate in FIG. 6B.

FIG. 6D is a graph showing a temporal change in ion generation rate assigned to each of the electric charge providers 211-216 based on the temporal change of the UFP generation rate in FIG. 6B. During the printing periods PRT, the UFP generation rate is predicted to rise, and thus, there is a higher risk of increase in number of UFPs leaking from the MFP 100 into external air. In order to sufficiently reduce the risk, the main controller section 60 determines target values of the ion generation rates of the electric charge providers 211-216 according to the operation conditions of the MFP 100, in the same manner as a target amount of intake flow of the fan 71. Concretely, the main controller section 60 first measures the fusing temperature, or predicts it from the operation mode of the MFP 100. When the measured or predicted level of the fusing temperature indicates a high level of the running mode, the main controller section 60 then estimates an amount of the rise in UFP generation rate or a height of the peak PK from a paper type specified by the operation data OPD or a coverage indicated by the image data. The higher the estimated value, the more greatly the main controller section 60 increases target levels of the ion generation rates to be assigned to the electric charge providers 211-216. For example, target levels for the electric charge providers 211-215 mounted in the first location are maintained at a relatively lower, constant level NiD during the waiting period WTT of the MFP 100, and at a higher level Ni1 or Ni2 during the printing period PRT when the peak PK appearing in UFP generation rate is predicted to be higher. See a graph represented by solid lines in FIG. 6D. A target level for the sixth electric charge provider 216 mounted in the second location is maintained at a constant level NiS from the start time t2 of the waiting period WTT until a fixed time Δtc is elapsed, and at zero during other periods. See a graph represented by dot-and-dash lines in FIG. 6D. In short, the sixth electric charge provider 216 is stopped during the other periods. This is because of the following reason. In the second location, there can be a risk of leaking UFPs only during a period when the fan 71 stops. During the waiting period WTT, the fusing temperature is maintained at the relatively lower level Twt for the waiting mode, and thus the UFP generation rate continues to fall. Accordingly, when the fixed time Δtc is elapsed from the start time t2 of the waiting period WTT, there will remain an ignorable number of UFPs capable of leaking.

Reduction of UFP by Electric Charge Provider

Figure 7A:
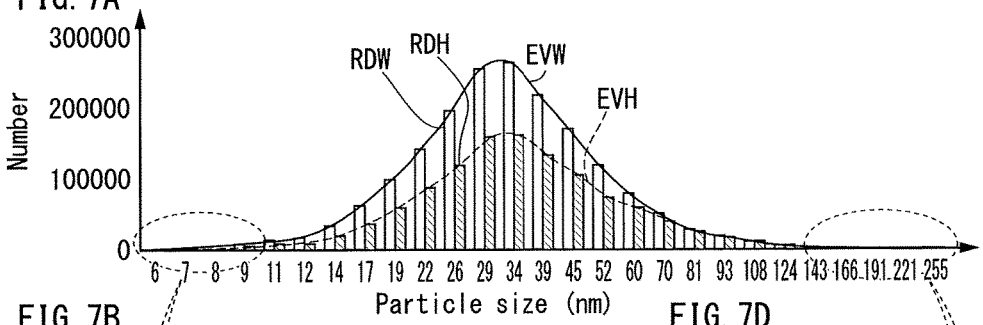
FIG. 7A is a histogram showing an example of diameter distribution of UFPs actually generated in the fuser section and its vicinity.
Figure 7B:
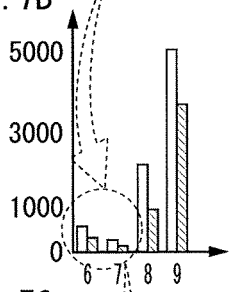
FIG. 7B is an enlargement of FIG. 7A for a range of diameters of 9 nm or smaller.
Figure 7D:
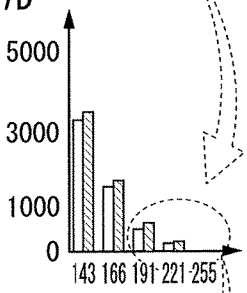
FIG. 7D is an enlargement of FIG. 7A for a range of diameters of 143 nm or larger.
Figure 7C:
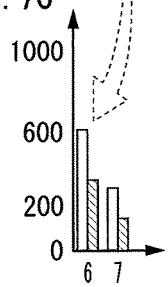
FIG. 7C is an enlargement of FIG. 7B for a range of diameters of 7 nm or smaller.
Figure 7E:
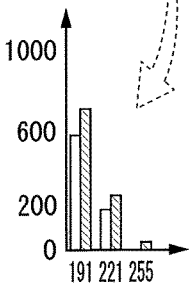
FIG. 7E is an enlargement of FIG. 7D for a range of diameters of 191 nm or larger.

FIG. 7A is a histogram showing an example of diameter distribution of UFPs actually generated in the fuser section 30 and its vicinity. Each value of diameter is associated with two types of bars: white and hatched. White bars RDW indicate the number of UFPs when no electric charge providers are mounted in the UFP appearance region. Hatched bars RDH indicate the number of UFPs when the electric charge providers are mounted and operate in the UFP appearance region. As shown in an envelop curve EVW connecting between the tops of white bars RDW, a typical diameter distribution of UFPs is a normal distribution with a mean value of tens of nanometers (about 30 nm in FIG. 7A) and a standard deviation of ten and some nanometers (about 12 nm in FIG. 7A). When an electric charge provider operates in a space where UFPs with diameters showing this distribution EVW are floating, the diameter distribution EVW deforms as shown in an envelop curve EVH connecting between the tops of hatched bars RDH. Comparing with the original diameter distribution EVW, the deforming diameter distribution EVH has an area surrounded with the envelop curve and horizontal axis, i.e. the total number of UFPs, that is reduced to about 60%.

FIGS. 7B, 7C, 7D, and 7E are, of the histogram in FIG. 7A, enlarged diagrams of portions showing diameters of 9 nm or less, 7 nm or less, 143 nm or more, and 191 nm or more, respectively. Comparing the number of UFPs of each diameter between the two diameter distributions EVW, EVH, UFPs of each diameter are reduced at the same rate, by about 40%, when the UFPs have diameters of 52 nm or less, while UFPs of a larger diameter are reduced at a lower rate when the UFPs have diameters of 60 nm or more. When UFPs have diameters of 143 nm or more, the UFPs of each diameter are increased in number.

From the above-described facts, the following is confirmed. When the electric charge providers generate minus air ions in a space where UFPs are floating, two or more UFPs clump together with a minus air ion as a core, and then grow a single larger UFP. This results in a reduction in total number of UFPs and an increase of the ratio in number of larger-sized UFPs, e.g. UFPs of diameters of 100 nm or more.

Figure 7F:
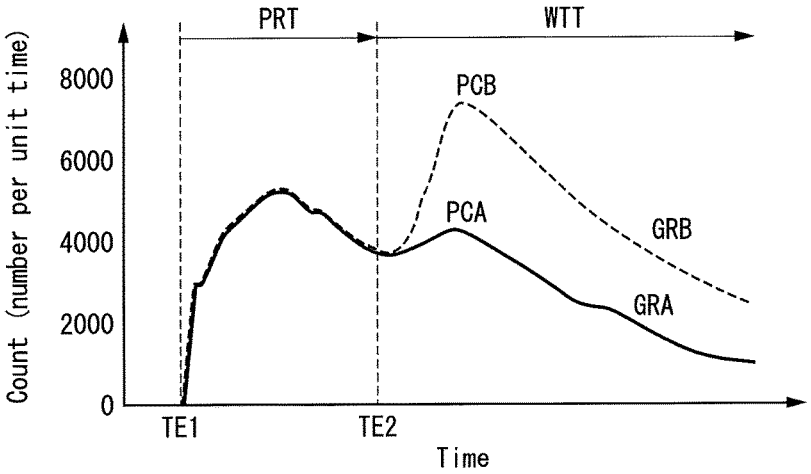
FIG. 7F is a graph showing a temporal change in number of UFPs actually counted per unit time that leak from the clearances at the perimeter of a door in FIG. 4 to the outside of the printer.

FIG. 7F is a graph showing a temporal change in number of UFPs actually counted per unit time that leak from the clearances at the perimeter of the door 134 in FIG. 4 to the outside of the MFP 100. A broken curve GRB shows the temporal change when the sixth electric charge provider 216 is absent, and a solid curve GRA shows the temporal change when the sixth electric charge provider 216 is present. In this experiment, the MFP 100 starts printing at the time TE1 when counting the UFPs is started, and since the time TE2 when finishing the printing, the MFP 100 maintains its waiting mode. When the sixth electric charge provider 216 is absent, as shown by the broken curve GRB, the number of UFPs leaking from the clearances at the perimeter of the door 134 per unit time, which is hereinafter referred to as "leak rate of UFPs," rapidly rises since the time TE2 when the MFP 100 finishes the printing, and reaches a large peak PKB after some minutes. From this fact, we find that during operation of the fan 71, UFPs hardly leak from the clearances at the perimeter of the door 134, but once the fan 71 stops, UFPs easily leak from the clearances. When the sixth electric charge provider 216 is present, as shown by the solid curve GRA, the leak rate of UFPs has a greatly reduced peak PKA caused by finish of the printing. From this fact, we confirm that at the time TE2 when the MFP 100 finishes the printing and changes to the waiting mode, the sixth electric charge provider 216 starts generating minus air ions, and accordingly, UFPs clump together with minus air ions as cores, and are reduced in number. Thus, there remains a small number of UFPs capable of leaking from the clearances at the perimeter of the door 134 even when the clearances allow UFPs to easily leak therefrom due to stop of the fan 71.

Merit of Embodiment

The MFP 100 according to the above-described embodiment of the invention has the first to five electric charge providers 211-215 in the first location and the sixth electric charge provider 216 in the second location. The first location is a region inside the body that is out of the path of the air flow ARF to the air inlet 414 caused by the action of the fan 71. The second location is a region inside the body through which external air flows in the body caused by the action of the fan 71. These electric charge providers 211-216 emit electric charges in ambient air to generate minus air ions. Caused by electrostatic forces of the minus air ions, two or more UFPs floating in the ambient air clump together into a single large UFP. This results in a reduction in number of UFPs. Thus, the MFP 100 can reduce the number of UFPs that avoid flowing in the filter 72 and leak from the body to external air.

Modification (A) The image forming device according to the above-described embodiment of the invention is the MFP 100. Alternatively, an image forming device according to an embodiment of the invention may be a single-function device such as a laser printer, copier, or fax machine.

(B) In FIGS. 2A, 2B, the air inlet 414 is provided in the inner guide 411, and thus, faces the front side of a sheet that includes a toner image immediately after fusing. An air inlet may be alternatively provided at a place where the inlet cannot face any area of the faces of sheets moving through the conveyance path.

The suction unit 70 in FIGS. 2A, 2B, has the function of releasing heat from the fuser section 30 in addition to the function of collecting UFPs. Another ventilation for heat release may be provided in the vicinity of, e.g. a control circuit board, power supply board, motor for driving a conveyance roller, motor for driving a polygon mirror built in the exposure unit, or ejection tray built in the body. With a filter incorporated, the ventilation may have an additional function of collecting UFPs. For the ventilation in any place, installation of the electric charge provider in the first or second location is effective for reduction of UFPs capable of leaking out of the body.

(C) The electric charge providers 211-216 in FIGS. 2A, 2B, 3A-3C, have the ion generator of a corona discharge or electron emission type. These ion generators may be of another type such as a creeping discharge type. In the above-described embodiment, it is assumed that air ions generated by the electric charge providers 211-216 have minus charges. Even when the air ions are clusters with plus charges such as $(H_3O)^+(H_2O)_n$, the air ions may be effective for a reduction in number of UFPs since they can function as cores inducing UFPs to clump therearound. The electric charge providers may have both first and second chargers disclosed in, e.g. JP 2016-024428, instead of the ion generators. The first charger provides positive charges to some UFPs floating in ambient air, and the second charger provides negative charges to other UFPs. The UFPs with opposite electric polarities can be drawn to each other and clump together.

(D) The example in FIG. 6D shows that a continuous operation time per activation of the sixth electric charge provider 216 in the second location is fixed to a constant time Δtc. The continuous operation time may only have a constant upper limit. In other words, the main controller section 60 may change the continuous operation time not to exceed the upper limit, each time activating the sixth electric charge provider 216. Since, in a warmup or recovery period of the MFP 100, a large number of UFPs can appear in the fuser section 30 and its vicinity once the fusing temperature reaches a sufficiently high level, the main controller section 60 may activate the sixth electric charge provider 216, even before activating the fan 71.

(E) "Initial bursts" are known to occur in generation of UFPs by image forming devices. Initial bursts are instantaneous rises in UFP generation rate, which can be seen immediately after an image forming device starts printing in conditions its fuser section has a temperature nearly equal to a room temperature due to a long-lasting power-off. The typical UFP generation rate in an initial burst is enormously high relative to that in the following printing period PRT. Accordingly, the main controller section 60 may set the ion generation rates of the electric charge providers 211-216 to higher values during a period an initial burst can occur than the values Ni1, Ni2 during the printing periods PRT in FIG. 6D.

(F) The main controller section 60 in the above-described embodiment estimates an increment of the UFP generation rate from the paper type specified by operation information OPD or the coverage indicated by image data, and when estimating a larger value, greatly increases the ion generation rates to be assigned the electric charge providers 211-216. Alternatively, the main controller section 60 may measure the intake flow amount of the fan 71, or estimate it from its current target amount, and according to the measured or estimated amount, determine the ion generation rates.

Supplement

Based on the above-described embodiment, the invention may be further characterized as follows.

The image forming device may include an ejector conveying a sheet from the fuser to the outside of the body along an ejection path inside the body. The suction unit may include an air inlet into which air flows from the inside of the ejection path. The electric charge provider may be mounted in at least the first location and the first location may include a region facing the surface of a sheet with a fused toner image, the region belonging to one of a portion of the ejection path downstream of the air inlet, an external surface of the ejection path or its vicinity, and an inner surface of the ejection path. The image forming device may include a manual feed tray allowing a sheet without a toner image to be place thereon, and a conveyor conveying the sheet from the manual feed tray to the fuser along a conveyance path inside the body. The electric charge provider may be mounted in at least the first location and the first location may include an inlet of the conveyance path facing the manual feed tray.

The electric charge provider, at least when mounted in the second location, may operate during suspension of the suction unit. The suspension period of the suction unit may include at least one of warm-up, recovery, and waiting periods of the image forming device. The electric charge provider may be mounted at least in the second location and the second location may include an opening or clearance in the body through which external air flows in during operation of the suction unit, and from which internal air leaks out during suspension of the suction unit. The body may include a door openable and closable in a vicinity of the fuser. The electric charge provider may be mounted at least in the second location and the second location may include a clearance surrounding the door. The image forming device may include an ejector conveying a sheet from the fuser to the outside of the body along an ejection path inside the body. The electric charge provider may be mounted at least in the second location and the second location may include a region of an outlet of the ejection path outside another region thereof through which a sheet can pass. The time length of a continuous action per activation of the electric charge provider may at least have a constant upper limit.

The image forming device may include a controller, and the controller may control an amount of charges to be omitted by the electric charge provider in its ambient air according to an estimated number of ultrafine particles floating in the ambient air. The controller may measure or estimate a temperature of the fuser, and according to the measured or estimated temperature, may determine the estimated number of ultrafine particles. The controller may estimate a coverage of a toner image fused on a sheet, and according to the estimated coverage, determine the estimated number of ultrafine particles. The controller may measure or estimate a volume of air sucked per unit time by the suction unit, and according to the measured or estimated volume, may determine the estimated number of ultrafine particles.

The suction unit may include a fan and a filter allowing air flows generated by the fan and removing ultrafine particles from the air flows. The electric charge provider may include an ion generator. The electric charge provider may include a first charger positively charging a group of ultrafine particles floating in ambient air and a second charger negatively charging another group of the ultrafine particles.

Although one or more embodiments of the present invention have been described and illustrated in detail, the disclosed embodiments are made for the purposes of illustration and example only and not limitation. The scope of the present invention should be interpreted by the terms of the appended claims.

What is claimed is:

1. An image forming device of an electrophotographic type comprising:

a fuser thermally fusing a toner image on a sheet;

a body containing the fuser;

a suction unit sucking air from the inside of the body; and an electric charge provider emitting electric charges in ambient air to cause ultrafine particles floating in the ambient air to clump together, the electric charge provider being mounted in either or both of first and second locations inside the body, the first location being at least one region out of a path of an air flow to the suction unit caused by the action of the suction unit, the second location being at least one region through which external air flows into the body due to the action of the suction unit.

2. The image forming device according to claim 1 further comprising an ejector conveying a sheet from the fuser to the outside of the body along an ejection path inside the body, wherein:

the suction unit includes an air inlet into which air flows from the inside of the ejection path; and the electric charge provider is mounted in at least the first location and the first location includes a region facing the surface of a sheet with a fused toner image, the region belonging to one of a portion of the ejection path downstream of the air inlet, an external surface of the ejection path or its vicinity, and an inner surface of the ejection path.

3. The image forming device according to claim 1 further comprising:

a manual feed tray allowing a sheet without a toner image to be placed thereon; and a conveyer conveying the sheet from the manual feed tray to the fuser along a conveyance path inside the body, wherein:

the electric charge provider is mounted in at least the first location and the first location includes an inlet of the conveyance path facing the manual feed tray.

4. The image forming device according to claim 1, wherein the electric charge provider, at least when mounted in the second location, operates during suspension of the suction unit.

5. The image forming device according to claim 4, wherein the suspension period of the suction unit includes at least one of warm-up, recovery, and waiting periods of the image forming device.

6. The image forming device according to claim 4, wherein the electric charge provider is mounted at least in the second location and the second location includes an opening or clearance in the body through which external air flows in during operation of the suction unit, and from which internal air leaks out during suspension of the suction unit.

7. The image forming device according to claim 4, wherein:

the body includes a door openable and closable in a vicinity of the fuser; and the electric charge provider is mounted at least in the second location and the second location includes a clearance surrounding the door.

8. The image forming device according to claim 4 further comprising an ejector conveying a sheet from the fuser to the outside of the body along an ejection path inside the body, wherein:

the electric charge provider is mounted at least in the second location and the second location includes a region of an outlet of the ejection path outside another region thereof through which a sheet can pass.

9. The image forming device according to claim 4 wherein the time length of a continuous action per activation of the electric charge provider at least has a constant upper limit.

10. The image forming device according to claim 1 further comprising a controller controlling an amount of charges to be emitted by the electric charge provider in its ambient air according to an estimated number of ultrafine particles floating in the ambient air.

11. The image forming device according to claim 10 wherein the controller measures or estimates a temperature of the fuser, and according to the measured or estimated temperature, determines the estimated number of ultrafine particles.

12. The image forming device according to claim 10 wherein the controller estimates a coverage of a toner image fused on a sheet, and according to the estimated coverage, determines the estimated number of ultrafine particles.

13. The image forming device according to claim 10 wherein the controller measures or estimates a volume of air sucked per unit time by the suction unit, and according to the measured or estimated volume, determines the estimated number of ultrafine particles.

14. The image forming device according to claim 1 wherein the suction unit includes a fan and a filter allowing air flows generated by the fan and removing ultrafine particles from the air flows.

15. The image forming device according to claim 1 wherein the electric charge provider includes an ion generator.

16. The image forming device according to claim 1 wherein the electric charge provider includes a first charger positively charging a group of ultrafine particles floating in ambient air and a second charger negatively charging another group of the ultrafine particles.

* * * * *